US006347860B1

(12) United States Patent
Choi

(10) Patent No.: US 6,347,860 B1
(45) Date of Patent: Feb. 19, 2002

(54) PRINTER HEAD USING SHAPE MEMORY ALLOY AND METHOD FOR MANUFACTURING THE SAME

(75) Inventor: Hae-Yong Choi, Kunpo-shi (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/342,696

(22) Filed: Jun. 29, 1999

(30) Foreign Application Priority Data

Dec. 30, 1998 (KR) ..... 98-60647

(51) Int. Cl.[7] ..... B41J 2/04
(52) U.S. Cl. ..... 347/54
(58) Field of Search ..... 347/54, 68, 69, 347/70, 71, 72, 50, 40; 399/261; 361/700; 310/328–330; 29/890.1

(56) References Cited

U.S. PATENT DOCUMENTS 6,130,689 A * 10/2000 Choi

FOREIGN PATENT DOCUMENTS

JP 2875242 1/1999

* cited by examiner

*Primary Examiner*—Raquel Yvette Gordon
(74) *Attorney, Agent, or Firm*—Darby & Darby

(57) ABSTRACT

Disclosed are a printer head using shape memory alloy and a method for manufacturing the same. The printer head using shape memory alloy comprises a substrate; space parts defined at both sides of the substrate; a vibrating plate formed on the substrate such that it covers the space parts, to be vibrated while being changed in its contour depending upon temperature variation, the vibrating plate including a shape memory alloy layer and a silicon dioxide layer; an electrode formed on the vibrating plate to have a desired pattern; an insulating layer formed to protect the electrode; an ink storing chamber formed between the space parts of the substrate for storing ink; a pressure chamber defined on the vibrating plate for containing ink, the pressure chamber discharging ink by vibration of the vibrating plate; a fluid passage plate formed at a side of the pressure chamber; a fluid passage formed by the fluid passage plate for allowing the ink stored in the ink storing chamber to flow into the pressure chamber; a nozzle plate attached onto the fluid passage plate for allowing ink to be fired in the form of droplets when the vibrating plate is vibrated; and a plurality of nozzles formed in the nozzle plate and firing ink to a recording device.

37 Claims, 14 Drawing Sheets

PRINTER HEAD USING SHAPE MEMORY ALLOY AND METHOD FOR MANUFACTURING THE SAME

BACKGROUND OF THE INVENTION

1. Field of the Invention

The present invention relates to a printer head using shape memory alloy and a method for manufacturing the same, and more particularly, the present invention relates to a method for manufacturing a printer head using shape memory alloy by a semiconductor process and an etching technique and a printer head using shape memory alloy manufactured by the method.

2. Description of the Related Art

Generally, drop-on-demand (DOD) type printer heads which fire liquid ink only under necessity are most widely used for ink jet printers. Use of such DOD type printer heads has gradually increased in that they require no electric charge or deflection of ink droplets and in that since high pressure is not needed, an easy printing is achieved by immediately firing ink droplets under atmospheric pressure.

Typical firing principles of such printer heads include a heating type firing method using a resistor, a vibration type firing method using a piezoelectric element, and a firing method using shape memory alloy, etc.

A printer head which adopts the heating type firing method generally includes a nozzle plate having a plurality of nozzles, a fluid passage plate coupled onto the nozzle plate and defining an ink storing chamber into which ink is stored, a substrate coupled onto the fluid passage plate and covering the ink storing chamber, and a heating resistor embedded into the substrate.

In an ink firing device of a printer head which adopts a heating type firing method, as shown in FIG. 1, ink is fired as described below.

First, if predetermined voltage is applied to a heating resistor 14, heat is generated. By the heat generated in the heating resistor 14, air contained in ink adjacent the heating resistor 14 is expanded to create air bubbles. By these air bubbles, ink 16 inside an ink storing chamber 10 is forced out through a nozzle 12 to be fired toward a recording medium.

The heating type firing method suffers from defects in that since ink is heated by heat generated in the heating resistor 14, the ink is likely to be chemically degraded, and this degraded ink may be deposited onto an inner surface of the nozzle 12 to clog the nozzle 12. Also, since the heating resistor 14 repeatedly generates heat upon application of voltage, a lifetime of the heating resistor 14 is shortened, and since only water soluble ink should be used, preserving property for a printed document is deteriorated.

A printer head which adopts the vibration type firing method generally includes a nozzle plate having a plurality of nozzles, a fluid passage plate coupled onto the nozzle plate and defining an ink storing chamber into which ink is stored, a substrate coupled onto the fluid passage plate and covering the ink storing chamber, and a piezoelectric element coupled onto the substrate and deforming the substrate while being vibrated when electric power is applied thereto.

In an ink firing device of a printer head which adopts a vibration type firing method, as shown in FIG. 2, ink is fired as described below.

If predetermined electric power is applied to a piezoelectric element 24, the piezoelectric element 24 is vibrated. By vibration of the piezoelectric element 24, volume of an ink storing chamber 20 is momentarily changed, and ink 26 inside the ink storing chamber 20 is forced out through a nozzle 22 to be fired toward a recording medium.

The vibration type firing method using the vibration of the piezoelectric element 24 provides an advantage in that since heat is not used, it is possible to use an ink other than water soluble ink and thereby a greater variety of choices are offered for ink. However, the vibration type firing method is encountered with problems in that since workability for the piezoelectric element is impaired and especially, it is difficult to form the piezoelectric element, productivity is reduced.

FIG. 3 is a cross-sectional view schematically illustrating an ink firing device of a printer head which uses shape memory alloy.

Shape memory alloy 32 which is in a flexurally deformed state is disposed above an ink storing chamber 30. If the shape memory alloy 32 which is in the flexurally deformed state is heated, the shape memory alloy 32 is returned to its original flattened state after a flexurally deformed portion is smoothed out.

As the shape memory alloy 32 is returned to its original flattened state, volume of the ink storing chamber 30 is decreased, and according to this, ink stored in the ink storing chamber 30 is fired through a nozzle 36 to a recording device (not shown).

A printer head using shape memory alloy is classified into a first type wherein several shape memory alloy layers having different phase transformation temperatures and different thicknesses are coupled one with another to be flexurally deformed and a second type wherein a shape limiting body and a shape memory alloy layer are coupled with each other to be flexurally deformed.

Because printer heads of these types employ shape memory alloy of a plate-shaped configuration which has a thickness of 50–1,000 $\mu$m and an area of 0.1–10 $mm^2$, power consumption is increased upon heating, heating and cooling times are lengthened to decrease operation frequency, and printing speed is lowered thereby deteriorating practicality of the entire printer head.

Moreover, since the shape memory alloy layer is thick and wide, it cannot be instantaneously heated, and displacement is slowly generated over a relatively long period of time. Accordingly, due to the fact that a generated pressure is reduced, ink may not be fired or may not be properly fired. Also, even in the case that ink is fired, because firing speed of droplets is decreased, wetting may be caused and thereby it is difficult to achieve stable firing of the droplets.

In addition, due to the fact that the shape memory alloy layer has a configuration of a plate which is large and thick and therefore, the entire structure thereof cannot but be enlarged, it is difficult to miniaturize the size of the printer head, integration density of nozzles is diminished and printing resolution is deteriorated.

In other words, in the case that the shape memory alloy is used as taught in the conventional art, the pressure chamber of the printer head must be enlarged such that it has a length of 100–10,000 $\mu$m and a width of 50–500 $\mu$m. Accordingly, if a pressure chamber of this size is used, the entire structure of the printer head cannot but also be enlarged.

Besides, since the printer head is constructed in that several shape memory alloy layers which are bonded one with another and bent, or a thin plate-shaped shape memory alloy layer and a shape limiting body which are bonded with each other and bent, are attached by bonding to a main body in which an ink storing chamber is defined, it is difficult to manufacture the printer head, and reliability is declined when the shape memory alloy is applied to the ink jet printer head which is required to be vibrated several ten million times.

Also, while an efficient structure is needed to improve ink firing capability, the conventional printer head using shape memory alloy mainly discloses aspects related with a firing method and firing particulars and does not mention structural details of the printer head.

SUMMARY OF THE INVENTION

Accordingly, the present invention has been made in an effort to solve the problems occurring in the related art, and an object of the present invention is to provide a method for manufacturing a printer head using shape memory alloy which is formed by a semiconductor thin film manufacturing process and has a thin film-shaped configuration and a printer head using shape memory alloy which is manufactured by the method, wherein configurations and sizes of a pressure chamber, a fluid passage and an ink storing chamber as being main components of the printer head are optimized to improve ink firing capability.

In order to achieve the above object, according to one aspect of the present invention, there is provided a method for manufacturing a printer head using shape memory alloy, comprising the steps of: preparing a silicon substrate having a flat configuration; thermally oxidizing the silicon substrate to form a pair of silicon dioxide layers on both surfaces of the silicon substrate, respectively; forming a shape memory alloy layer on one of the pair of silicon dioxide layers by a semiconductor thin film forming process; thermally treating the formed shape memory alloy layer; patterning the shape memory alloy layer; patterning the silicon dioxide layers formed on both surfaces of the silicon substrate, respectively; forming an electrode on the shape memory alloy layer to have a desired pattern; forming an insulating layer for protecting the electrode; forming a body of the printer head by etching the silicon substrate on which the electrode and insulating layer are formed; separately forming a nozzle plate into which a plurality of nozzles are formed; forming a fluid passage plate by bonding a photosensitive dry film onto the nozzle plate and patterning the photosensitive dry film; and bonding the nozzle plate and the fluid passage plate onto the body of the printer head. The method can further comprise the steps of: forming an auxiliary plate; applying a photosensitive dry film on the auxiliary plate and patterning the photosensitive dry film; and bonding the auxiliary plate on which the photosensitive dry film is patterned, onto the other of the pair of silicon dioxide layers.

According to another aspect of the present invention, there is provided a method for manufacturing a printer head using shape memory alloy, comprising the steps of: preparing a silicon substrate having a flat configuration; thermally oxidizing the silicon substrate to form a pair of silicon dioxide layers on both surfaces of the silicon substrate, respectively; forming a shape memory alloy layer on one of the pair of silicon dioxide layers by a semiconductor thin film forming process; thermally treating the formed shape memory alloy layer; patterning the shape memory alloy layer; patterning the silicon dioxide layers formed on both surfaces of the silicon substrate, respectively; forming an electrode on the shape memory alloy layer to have a desired pattern; forming an insulating layer for protecting the electrode; applying a photosensitive dry film onto the insulating layer and patterning the photosensitive film; forming a body of the printer head by dry etching the formed silicon substrate; separately forming a nozzle plate into which a plurality of nozzles are formed; and bonding the nozzle plate onto the body of the printer head. The method can further comprise the steps of: forming an auxiliary plate; applying a photosensitive dry film on the auxiliary plate and patterning the photosensitive dry film; and bonding the auxiliary plate on which the photosensitive dry film is patterned, onto the other of the pair of silicon dioxide layers.

According to still another aspect of the present invention, there is provided a method for manufacturing a printer head using shape memory alloy, comprising the steps of: preparing a silicon substrate having a flat configuration; thermally oxidizing the silicon substrate to form a pair of silicon dioxide layers on both surfaces of the silicon substrate, respectively; forming a shape memory alloy layer on one of the pair of silicon dioxide layers by a semiconductor thin film forming process; thermally treating the formed shape memory alloy layer; patterning the shape memory alloy layer; patterning the silicon dioxide layers formed on both surfaces of the silicon substrate, respectively; forming an electrode on the shape memory alloy layer to have a desired pattern; forming an insulating layer for protecting the electrode; applying a photosensitive dry film onto the insulating layer and patterning the photosensitive film to define a body of the printer head; separately forming a nozzle plate into which a plurality of nozzles are formed; bonding the nozzle plate onto the body of the printer head; and dry etching the silicon substrate. The method can further comprise the steps of: forming an auxiliary plate; applying a photosensitive dry film on the auxiliary plate and patterning the photosensitive dry film; and bonding the auxiliary plate on which the photosensitive dry film is patterned, onto the other of the pair of silicon dioxide layers.

According to yet still another aspect of the present invention, there is provided a printer head using shape memory alloy comprising: a substrate; space parts defined at both sides of the substrate; a vibrating plate formed on the substrate such that it covers the space parts, to be vibrated while being changed in its contour depending upon temperature variation, the vibrating plate including a shape memory alloy layer and a silicon dioxide layer; an electrode formed on the vibrating plate to have a desired pattern; an insulating layer formed to protect the electrode; an ink storing chamber formed between the space parts of the substrate for storing ink; a pressure chamber defined on the vibrating plate for containing ink, the pressure chamber discharging ink by vibration of the vibrating plate; a fluid passage plate formed at a side of the pressure chamber; a fluid passage formed by the fluid passage plate for allowing the ink stored in the ink storing chamber to flow into the pressure chamber; a nozzle plate attached onto the fluid passage plate for allowing ink to be fired in the form of droplets when the vibrating plate is vibrated; and a plurality of nozzles formed in the nozzle plate for firing ink to a recording device.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION

Figure 1:
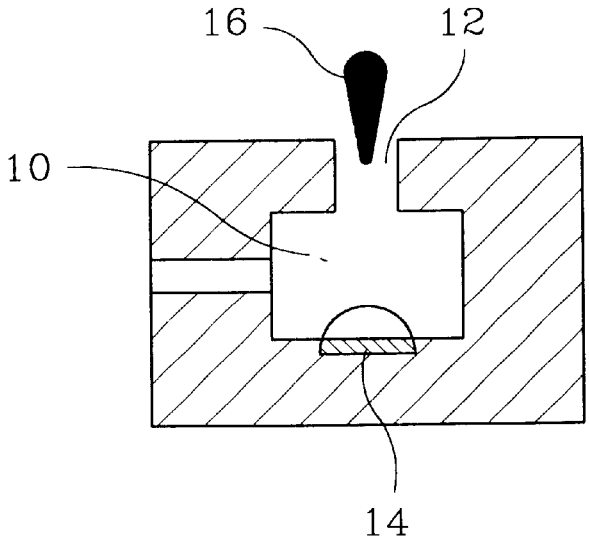
FIG. 1 is a cross-sectional view schematically illustrating an ink firing device of a printer head which adopts a heating type firing method.
Figure 2:
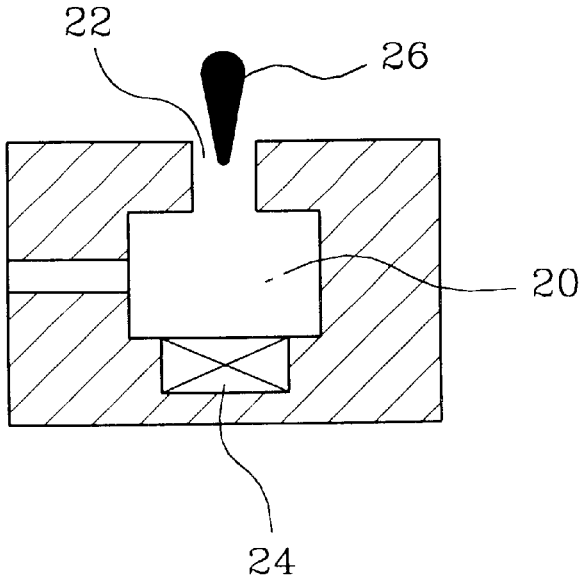
FIG. 2 is a cross-sectional view schematically illustrating an ink firing device of a printer head which adopts a vibration type firing method using a piezoelectric element.
Figure 3:
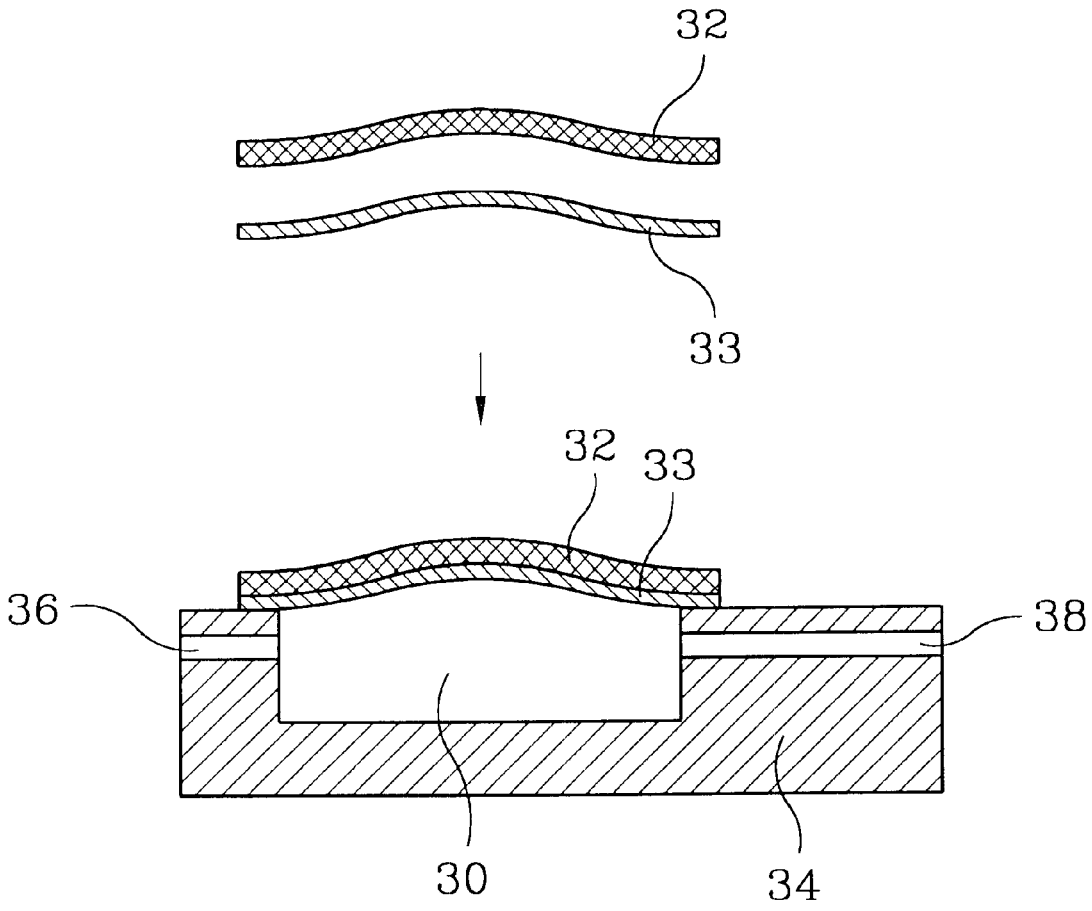
FIG. 3 is a cross-sectional view schematically illustrating an ink firing device of a printer head which uses shape memory alloy.
Figure 4:
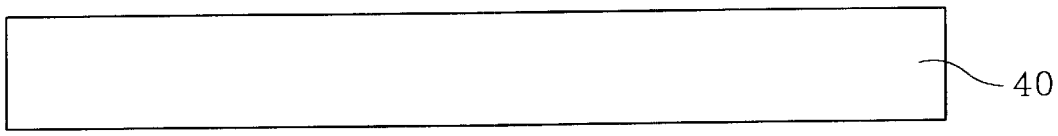
FIGS. 4 through 12 are cross-sectional views for explaining a method for manufacturing a printer head using shape memory alloy in accordance with an embodiment of the present invention.
Figure 5:
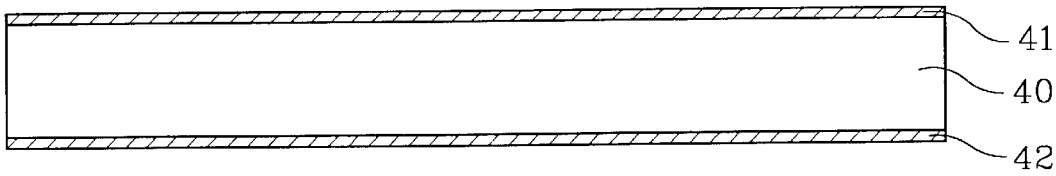
Figure 6:
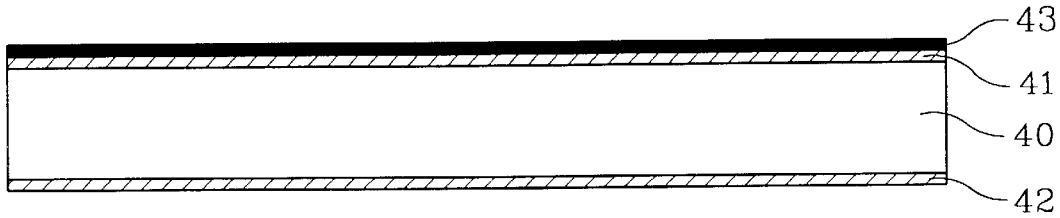
Figure 7:
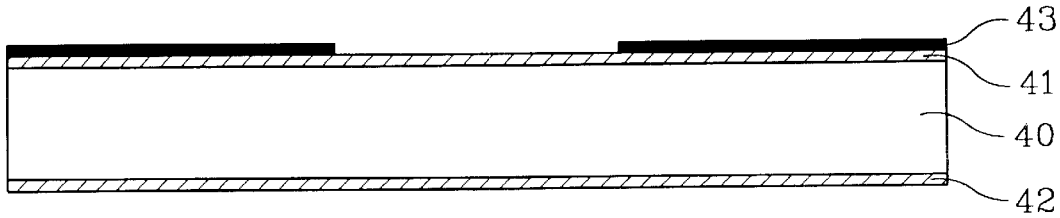
Figure 8:
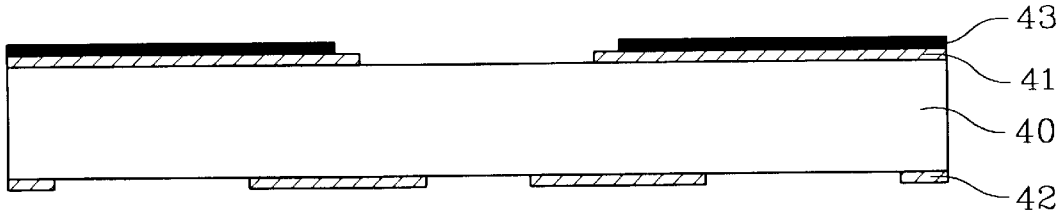
Figure 9:
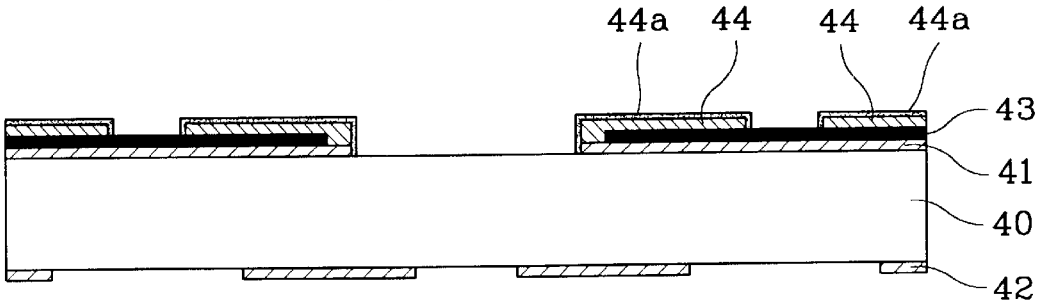
Figure 10:
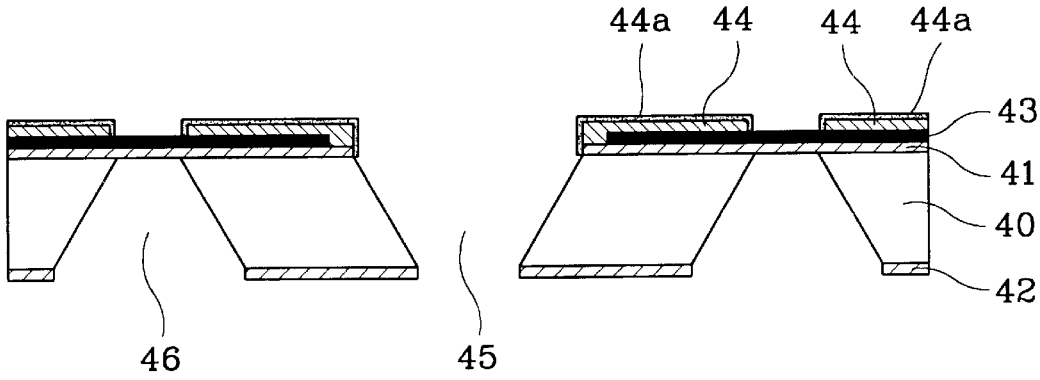
Figure 11:
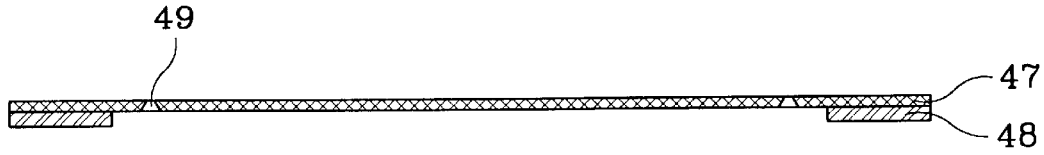
Figure 12:
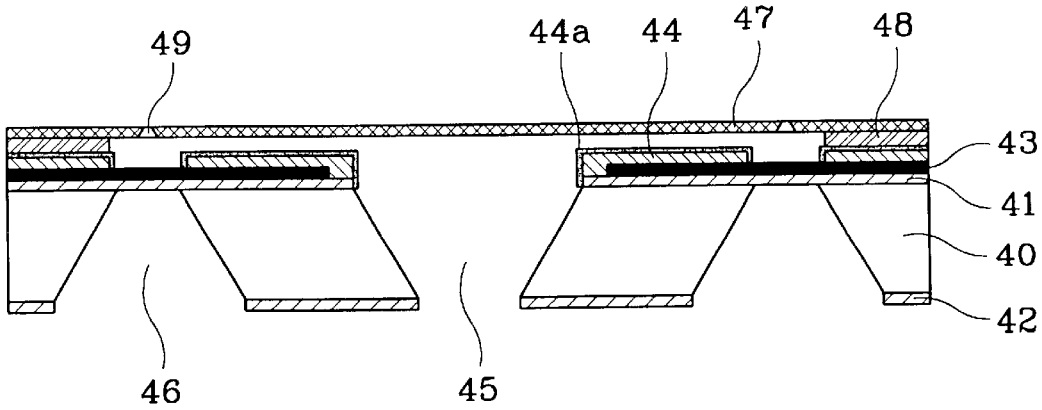
Figure 13:
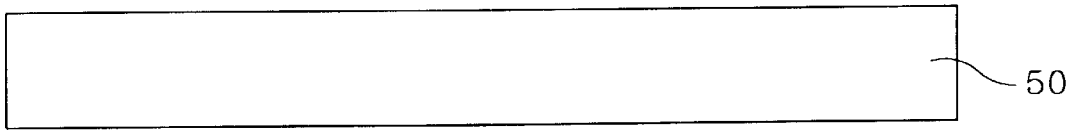
FIGS. 13 through 22 are cross-sectional views for explaining a method for manufacturing a printer head using shape memory alloy in accordance with another embodiment of the present invention.
Figure 14:
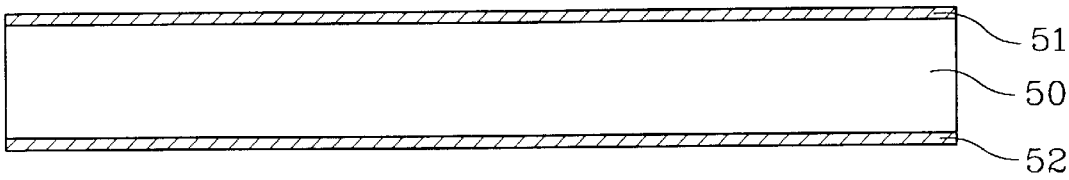
Figure 15:
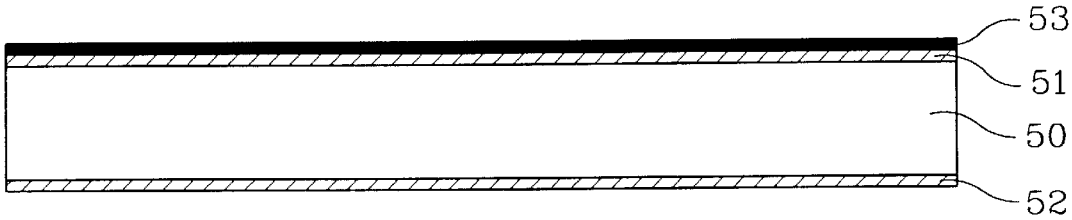
Figure 16:
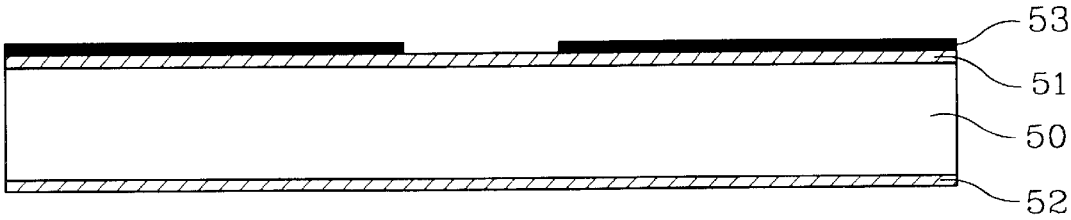
Figure 17:
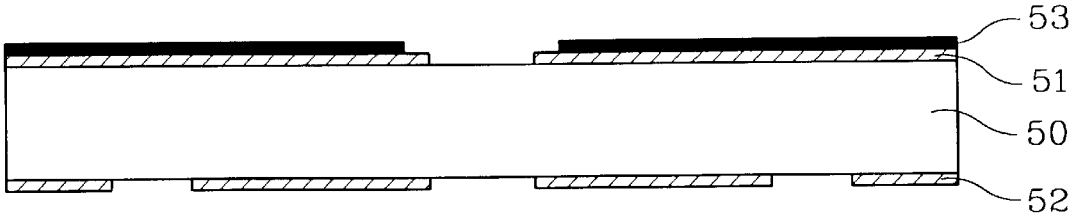
Figure 18:
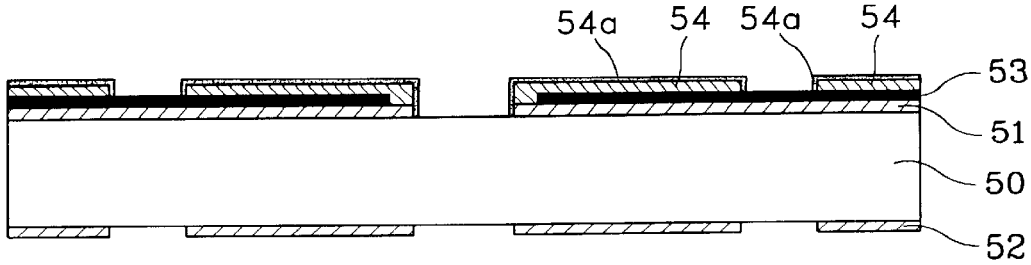
Figure 19:
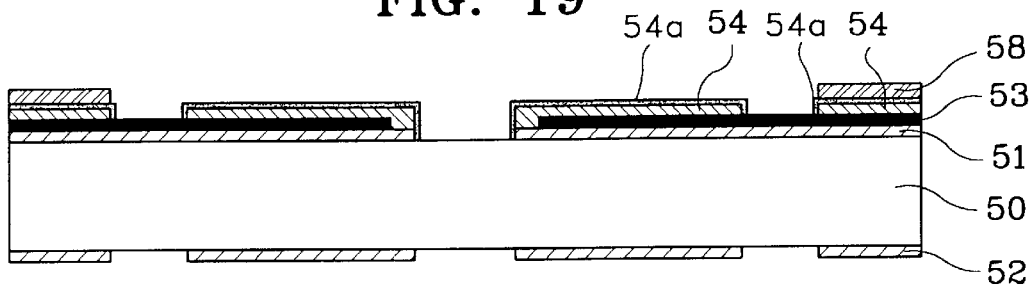
Figure 20:
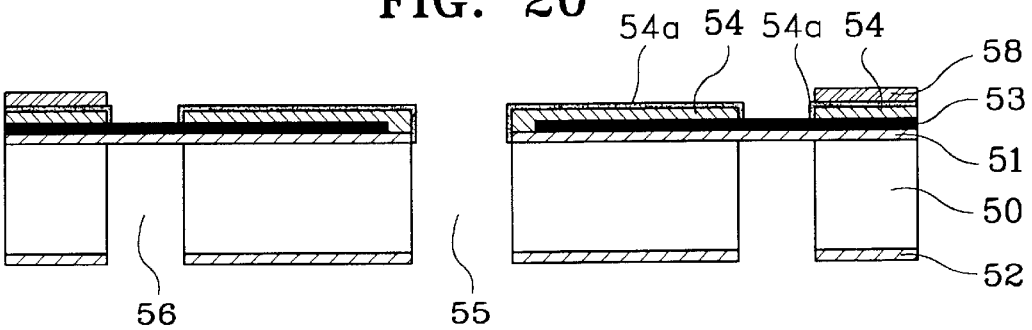
Figure 21:
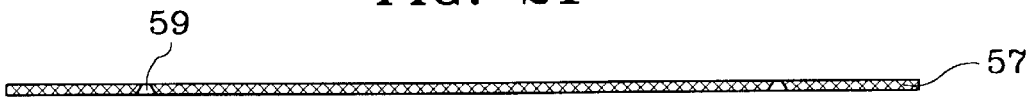
Figure 22:
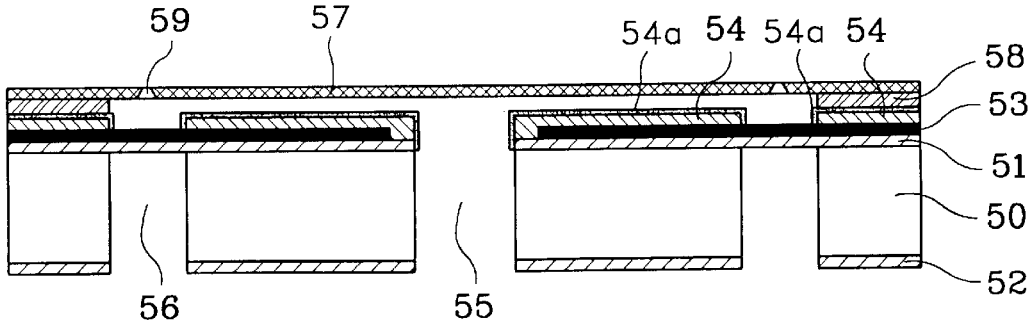
Figure 23:
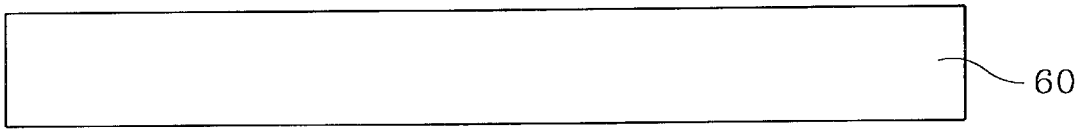
FIGS. 23 through 32 are cross-sectional views for explaining a method for manufacturing a printer head using shape memory alloy in accordance with another embodiment of the present invention.
Figure 24:
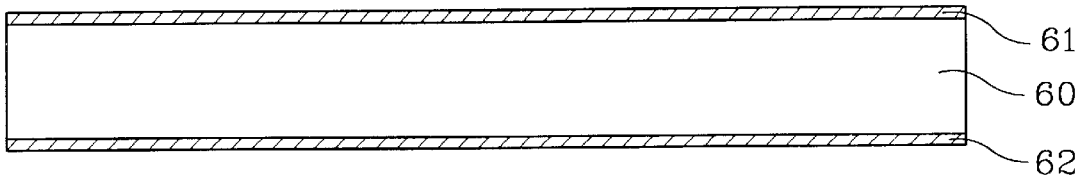
Figure 25:
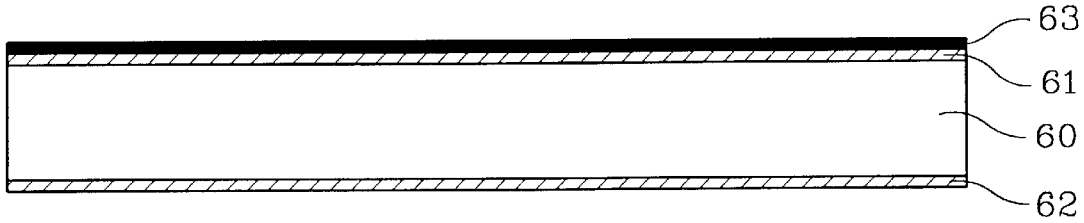
Figure 26:
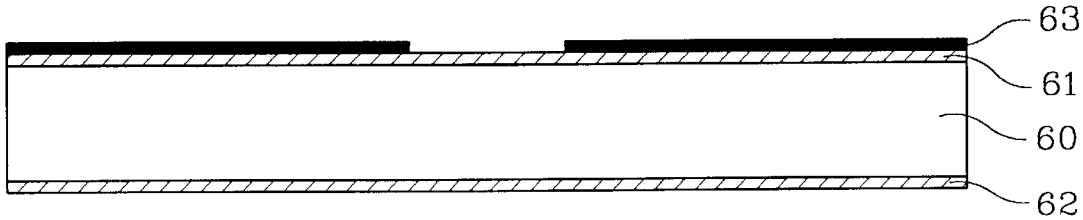
Figure 27:
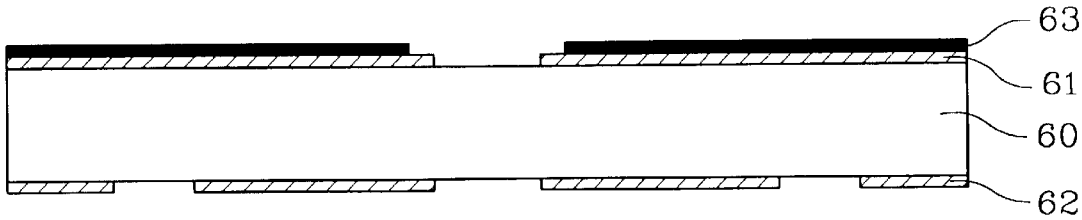
Figure 28:
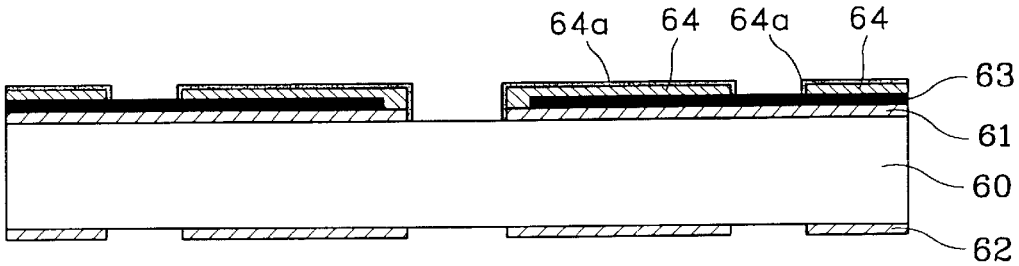
Figure 29:
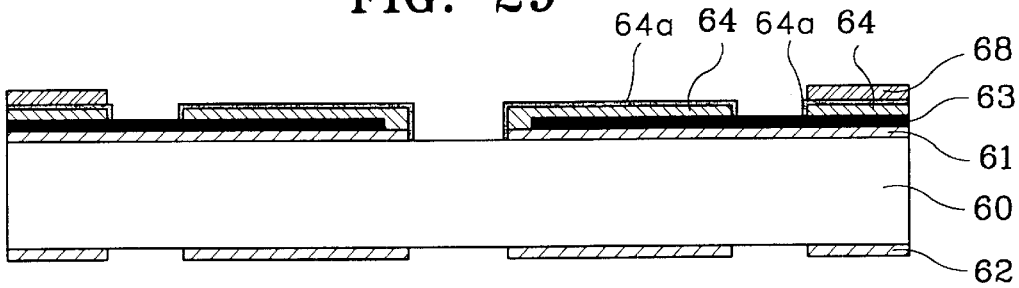
Figure 30:
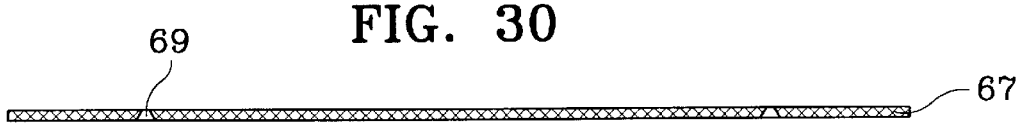
Figure 31:
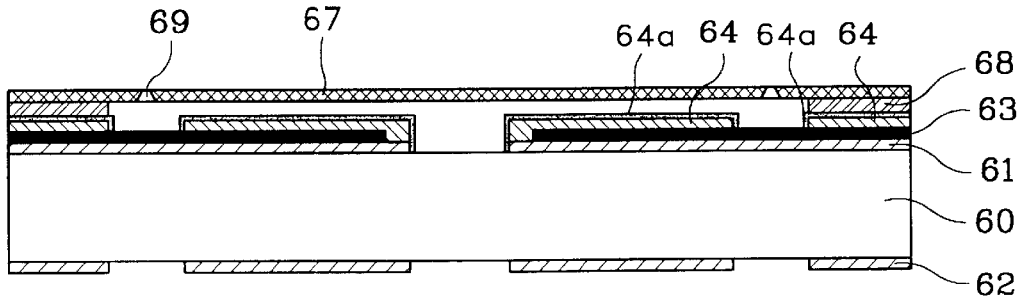
Figure 32:
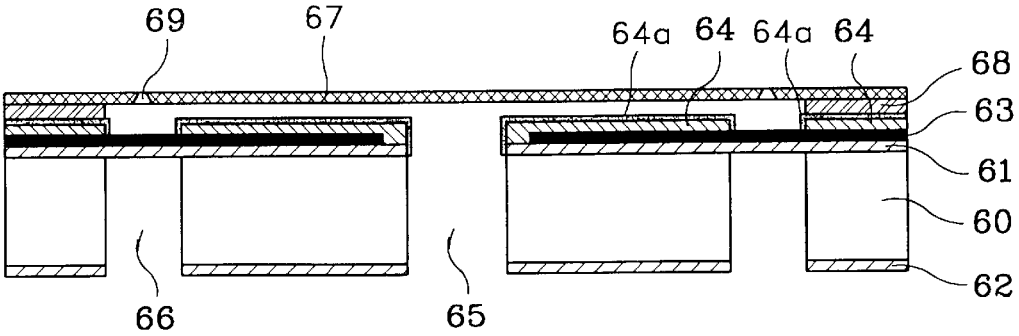
Figure 33:
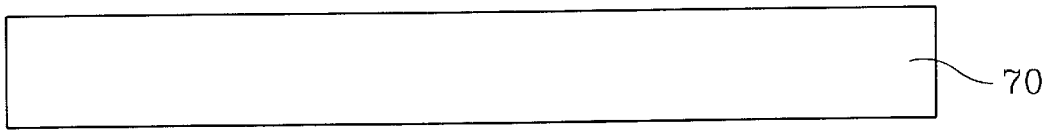
FIGS. 33 through 43 are cross-sectional views for explaining a method for manufacturing a printer head using shape memory alloy in accordance with another embodiment of the present invention.
Figure 34:
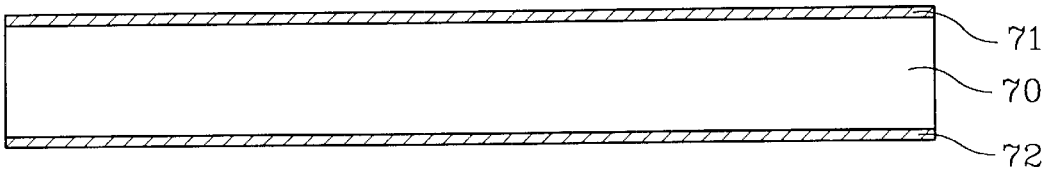
Figure 35:
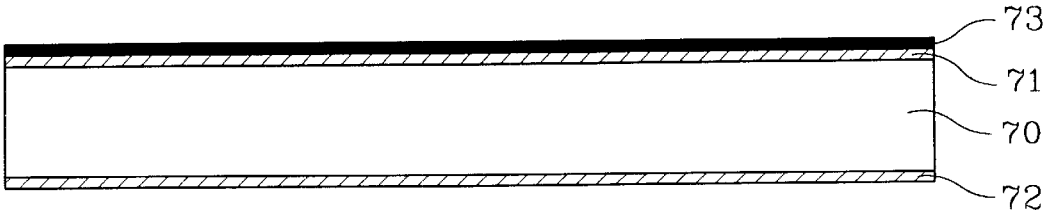
Figure 36:
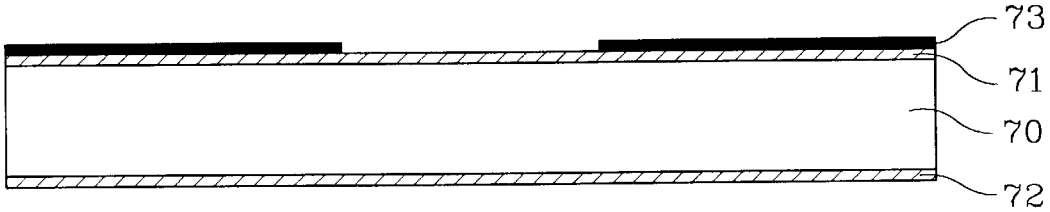
Figure 37:
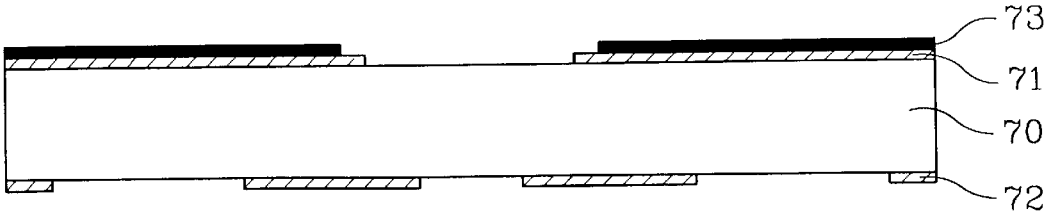
Figure 38:
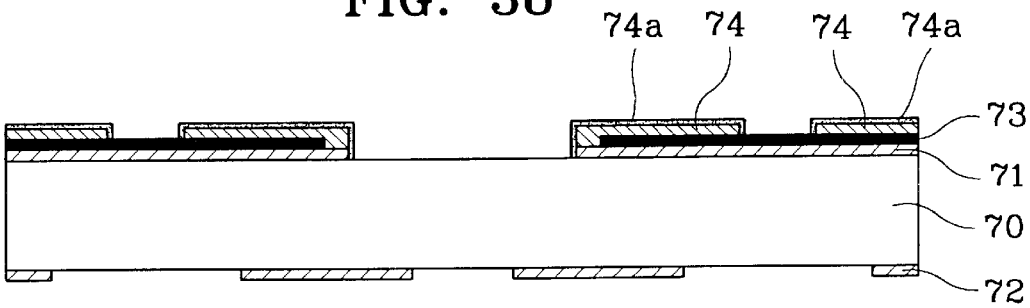
Figure 39:
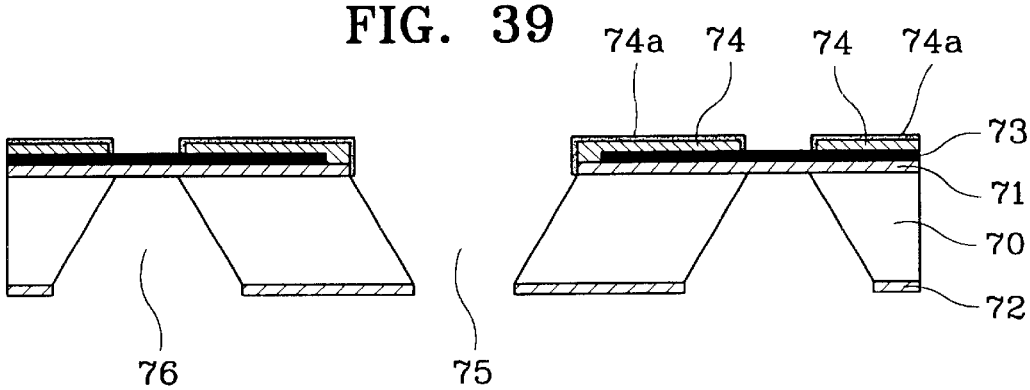
Figure 40:
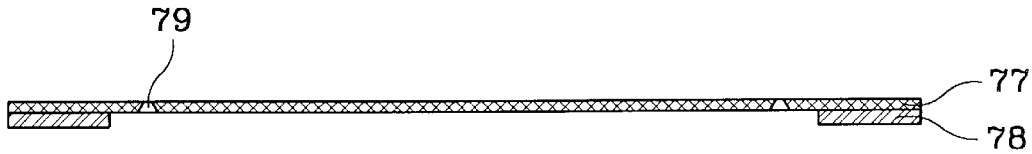
Figure 41:
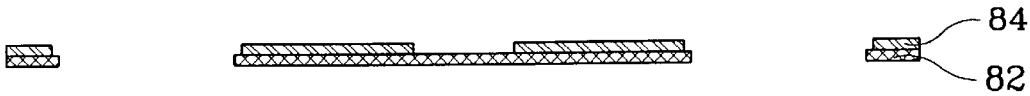
Figure 42:
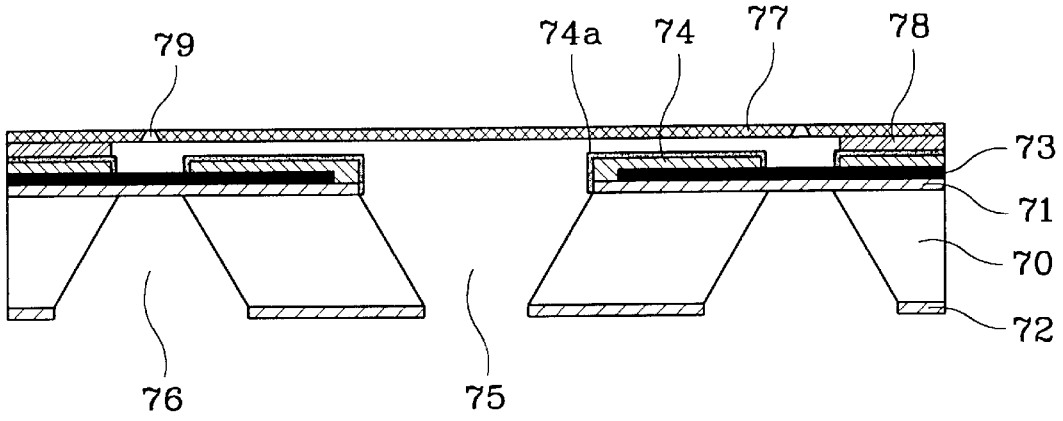
Figure 43:
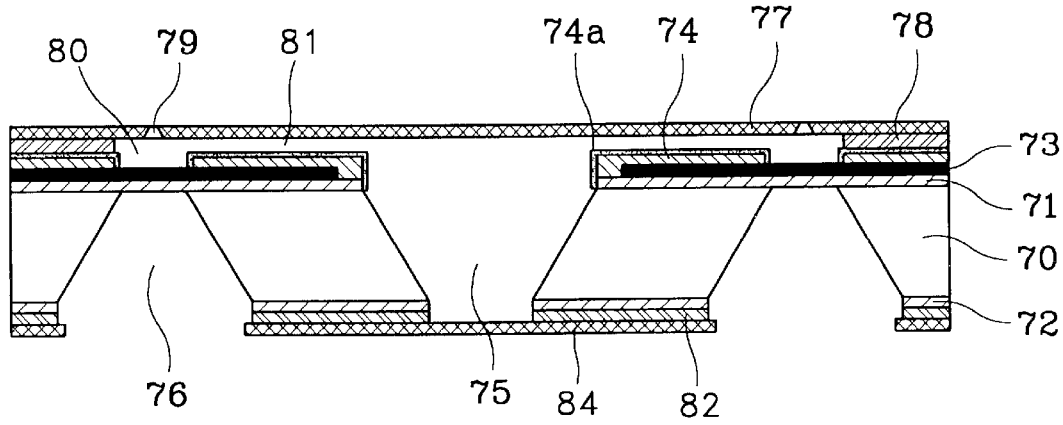

Hereinafter, the present invention will be described in detail.

A method for manufacturing a printer head using shape memory alloy of the present invention will be first described. The method for manufacturing a printer head using shape memory alloy is classified into three methods.

A first method for manufacturing a printer head using shape memory alloy of the present invention will be described below.

A flat plate-shaped silicon substrate is used as a substrate. The silicon substrate is thermally oxidized to form a pair of thermally oxidized films on both surfaces thereof, respectively. In order to thermally oxidize both surfaces of the silicon substrate, it is common to use a procedure wherein mixed gas of oxygen and water vapor is supplied at 1,100° C.

A silicon dioxide layer which is formed on the surface of the substrate serves as a second thin film in addition to shape memory alloy in the form of a thin film, when manufacturing of the printer head is completed. Further, since the silicon dioxide layer has compressive stress, it provides the shape memory alloy with restoring force for enabling the shape memory alloy flattened by heating to be flexurally deformed again while being cooled.

If the silicon dioxide layer is thick, energy consumption is increased when the shape memory alloy is flattened by heating, and if the silicon dioxide layer is thin, restoring force for restoring the shape memory alloy to its flexed state is reduced. Accordingly, it is preferred that the silicon dioxide layer has a thickness of 0.3–2.0 $\mu$m.

Shape memory alloy is deposited onto the thermally oxidized film of the silicon dioxide, which is formed on the silicon substrate, by a semiconductor thin film manufacturing process such as sputtering or the like, to form a thin film of shape memory alloy. The thin film of shape memory alloy is then thermally treated, that is, baked. If the shape memory alloy layer is thick, because various problems as mentioned in the descriptions for the related art are induced, it is preferred that the shape memory alloy layer has a thickness of 0.5–5 $\mu$m.

The shape memory alloy layer which is formed on the substrate and is thermally treated, is patterned to a desired pattern. As a method for patterning the shape memory alloy layer, a method for patterning by virtue of photolithography which uses a photoresist, or the like is used.

In implementing the photolithography, a photoresist is applied on the shape memory alloy layer by a method such as spin coating, laminating or the like to a predetermined thickness, and then, is exposed to light to define a desired pattern. After etching the photoresist which is formed to define the desired pattern, the shape memory alloy layer is also patterned to a desired pattern.

After the shape memory alloy layer is patterned to have the desired pattern, the silicon dioxide layers which are formed on both surfaces of the substrate, are further patterned. As a method for patterning the silicon dioxide layers, a method which is the same as that used for patterning the shape memory alloy layer is employed.

An electrode is formed on a vibrating plate which is formed by the patterned shape memory alloy layer and the patterned silicon dioxide layer, to a desired pattern. At this time, it is common that the electrode is made of material selected from a group consisting of aluminum (Al), gold (Au), platinum (Pt) and silver (Ag). The electrode is formed such that the vibrating plate is exposed to the outside above space parts.

After patterning the electrode, an insulating layer for protecting the electrode is formed on the electrode. As material of the insulating layer, material which does not conduct current well, such as a silicon oxide, a silicon nitride, etc. is used. As a method for forming the insulating layer, a method which is the same as that used for patterning the shape memory alloy layer can be employed.

After the silicon substrate is patterned, the silicon substrate is wholly etched to form space parts and an ink storing chamber, thereby to form a body of a printer head.

At this time, as an etching method, both a wet etching technique and a dry etching technique can be used.

However, in the case that the substrate is etched using a wet etching technique, an etching face is not vertical and forms an angle with respect to a vertical line, due to a difference in etching rate depending upon crystal orientation. If etching is performed from a bottom surface of the substrate, a distance between an ink storing chamber and a pressure chamber is lengthened due to an etching angle by a length which is no less than a thickness of a wafer, thereby to deteriorate the ink firing characteristic. Consequently, in order to shorten the distance between the ink storing chamber and the pressure chamber, etching must be performed from an upper part of the wafer.

In the meanwhile, if the substrate is etched using a dry etching technique, since an etching face is vertical, it is possible to reduce the distance between the ink storing chamber and the pressure chamber. Further, since integration density of nozzles can be raised, a structure of the printer head can be made small, an entire printer head can be miniaturized, and printing resolution can be elevated. Therefore, it is preferred to use a dry etching technique.

If the space parts are formed by etching the substrate on which the shape memory alloy layer is formed, the shape memory alloy layer is flexurally deformed due to a buckling phenomenon by the compression stress which resides in the silicon dioxide layer, and is maintained as it is flexurally deformed.

A nozzle plate in which a plurality of nozzles are defined is separately formed. A photosensitive dry film is bonded to the nozzle plate. By exposing the bonded photosensitive dry film and patterning the photosensitive dry film to a desired pattern, a fluid passage plate is prepared.

The fluid passage plate of the nozzle plate, which is patterned to the desired pattern and the body of the printer head manufactured as described above are bonded with each other to complete the printer head. The fluid passage plate and the printer head are bonded with each other while a predetermined pressure is applied at a high temperature.

A second method for manufacturing a printer head using shape memory alloy of the present invention will be described below.

Of course, at this time, a flat plate-shaped silicon substrate is used as a substrate. The silicon substrate is thermally oxidized to form a pair of thermally oxidized films on both surfaces thereof, respectively. In order to thermally oxidize both surfaces of the silicon substrate, it is common to use a procedure wherein mixed gas of oxygen and water vapor is supplied at 1,100° C.

It is preferred that a silicon dioxide layer formed on the surface of the substrate has a thickness of 0.3–2.0 $\mu$m.

Shape memory alloy is deposited onto the thermally oxidized film of the silicon dioxide, which is formed on the silicon substrate, by a semiconductor thin film manufacturing process such as sputtering or the like, to form a thin film of shape memory alloy. The thin film of shape memory alloy is then thermally treated, that is, baked. At this time, it is preferred that the shape memory alloy layer has a thickness of 0.5–5 $\mu$m.

The formed shape memory alloy layer is patterned to a desired pattern. As a method for patterning the shape memory alloy layer, a method for patterning by virtue of photolithography which uses a photoresist, or the like is used.

In implementing the photolithography, a photoresist is applied on the shape memory alloy layer by a method such as spin coating, laminating or the like to a predetermined thickness, and then, is exposed to light to define a desired pattern. After etching the photoresist which is formed to define the desired pattern, the shape memory alloy layer is also patterned to a desired pattern.

After the shape memory alloy layer is patterned to have the desired pattern, the silicon dioxide layers which are formed on both surfaces of the substrate, are further patterned. As a method for patterning the silicon dioxide layers, a method which is the same as that used for patterning the shape memory alloy layer is employed.

An electrode is formed on a vibrating plate which is formed by the patterned shape memory alloy layer and the patterned silicon dioxide layer, to a desired pattern. At this time, it is common that the electrode is made of material selected from a group consisting of aluminum (Al), gold (Au), platinum (Pt) and silver (Ag). The electrode is formed such that the vibrating plate is exposed to the outside above space parts.

After patterning the electrode, an insulating layer for protecting the electrode is formed on the electrode. As material of the insulating layer, material which does not conduct current well, such as a silicon oxide, a silicon nitride, etc. is used. As a method for forming the insulating layer, a method which is the same as that used for patterning the shape memory alloy layer can be employed.

A photosensitive dry film is bonded onto the insulating layer which is formed. By exposing the bonded photosensitive dry film and patterning the photosensitive dry film to a desired pattern, a fluid passage plate is prepared.

After patterning the photosensitive dry film, the silicon substrate is wholly etched by a dry etching technique to form space parts and an ink storing chamber, thereby to form a body of a printer head. At this time, while it is possible to use a wet etching technique, as described above, it is more efficient that a dry etching technique is used.

If the space parts are formed by etching the substrate on which the shape memory alloy layer is formed, the shape memory alloy layer is flexurally deformed due to a buckling phenomenon by the compression stress which resides in the silicon dioxide layer, and is maintained as it is flexurally deformed.

A nozzle plate in which a plurality of nozzles are defined is separately formed. The nozzle plate which is formed in this way, and the fluid passage plate of the body of the printer head are bonded with each other to complete the entire printer head. At this time, the nozzle plate and the printer head are bonded with each other while a predetermined pressure is applied at a high temperature.

A third method for manufacturing a printer head using shape memory alloy of the present invention will be described below.

Of course, at this time, a flat plate-shaped silicon substrate is used as a substrate. The silicon substrate is thermally oxidized to form a pair of thermally oxidized films on both surfaces thereof, respectively. In order to thermally oxidize both surfaces of the silicon substrate, it is common to use a procedure wherein mixed gas of oxygen and water vapor is supplied at 1,100° C.

It is preferred that a silicon dioxide layer formed on the surface of the substrate has a thickness of 0.3–2.0 $\mu$m.

Shape memory alloy is deposited onto the thermally oxidized film of the silicon dioxide, which is formed on the silicon substrate, by a semiconductor thin film manufacturing process such as sputtering or the like, to form a thin film of shape memory alloy. The thin film of shape memory alloy is then thermally treated, that is, baked. At this time, it is preferred that the shape memory alloy layer has a thickness of 0.5–5 $\mu$m.

The shape memory alloy layer which is formed on the substrate is patterned to a desired pattern. As a method for patterning the shape memory alloy layer, a method for patterning by virtue of photolithography which uses a photoresist, or the like is used.

In implementing the photolithography, a photoresist is applied on the shape memory alloy layer by a method such as spin coating, laminating or the like to a predetermined thickness, and then, is exposed to light to define a desired pattern. After etching the photoresist which is formed to define the desired pattern, the shape memory alloy layer is also patterned to a desired pattern.

After the shape memory alloy layer is patterned to have the desired pattern, the silicon dioxide layers which are formed on both surfaces of the substrate, are further patterned. As a method for patterning the silicon dioxide layers, a method which is the same as that used for patterning the shape memory alloy layer is employed.

An electrode is formed on a vibrating plate which is formed by the patterned shape memory alloy layer and the patterned silicon dioxide layer, to a desired pattern. At this time, it is common that the electrode is made of material selected from a group consisting of aluminum (Al), gold (Au), platinum (Pt) and silver (Ag). The electrode is formed such that portions of the vibrating plate are not covered by the insulating layer, that is, they are exposed at portions above the space parts.

After patterning the electrode, an insulating layer for protecting the electrode is formed on the electrode. As material of the insulating layer, material which does not conduct current well, such as a silicon oxide, a silicon nitride, etc. is used. As a method for forming the insulating layer, a method which is the same as that used for patterning the shape memory alloy layer can be employed.

A photosensitive dry film is bonded onto the insulating layer which is formed. By exposing the bonded photosensitive dry film and patterning the photosensitive dry film to a desired pattern, a fluid passage plate is prepared.

A nozzle plate in which a plurality of nozzles are defined is separately formed. The nozzle plate which is formed in this way, is bonded onto the fluid passage plate. At this time, the nozzle plate and the fluid passage plate are bonded with each other while a predetermined pressure is applied at a high temperature.

The silicon substrate on which the nozzle plate is bonded is wholly etched by a dry etching technique to form space parts and an ink storing chamber, thereby to form a body of a printer head.

In the printer head manufactured by the methods described above, the ink storing chamber is formed in a state that it is opened, and when connecting an ink cartridge, the ink cartridge and the body of the printer head are directly connected with each other.

The ink storing chamber serves as a part which stores ink and supplies ink into the pressure chamber. If the ink storing chamber is opened, when the ink cartridge is connected or disconnected or when the ink cartridge is incompletely connected, there is a possibility for ink to leak, whereby stability of the entire printer head is diminished.

Therefore, in order to form the ink storing chamber as a closed space, an auxiliary plate can be used.

It is preferred that the auxiliary plate is made of stainless steel (SUS) or nickel (Ni).

After the auxiliary plate is patterned to a pattern which is suitable for making the ink storing chamber as a closed space, a photosensitive dry film is bonded onto the auxiliary plate. The bonded photosensitive dry film is exposed to light and patterned to a desired pattern to be bonded to the printer body. At this time, because the photosensitive dry film is used as a portion for bonding the auxiliary plate to the printer head, the photosensitive dry film is patterned such that it is suited to a lower structure of the printer head to which it is bonded.

By bonding the patterned auxiliary plate through the photosensitive dry film to a lower part of the substrate, the ink storing chamber is closed. As a bonding method, a method which is the same as that used for bonding the nozzle plate can be employed.

Also, by simultaneously bonding the nozzle plate and the auxiliary plate, the number of manufacturing processes can be decreased.

The auxiliary plate which is bonded to the body of the printer head, is formed with an ink inlet port through which ink contained in the ink cartridge is supplied to the ink storing chamber.

By closing the ink storing chamber by using the auxiliary plate as described above, stability of the printer head can be improved.

Next, a printer head using shape memory alloy of the present invention will be described.

A printer head using shape memory alloy of the present invention comprises a substrate; space parts defined at both sides of the substrate; a vibrating plate formed on the substrate such that it covers the space parts, to be vibrated while being changed in its contour depending upon temperature variation, the vibrating plate including a shape memory alloy layer and a silicon dioxide layer; an electrode formed on the vibrating plate to have a desired pattern; an insulating layer formed to protect the electrode; an ink storing chamber formed between the space parts of the substrate for storing ink; a pressure chamber defined on the vibrating plate for containing ink, the pressure chamber discharging ink by vibration of the vibrating plate; a fluid passage plate formed at a side of the pressure chamber; a fluid passage formed by the fluid passage plate for allowing the ink stored in the ink storing chamber to flow into the pressure chamber; a nozzle plate attached onto the fluid passage plate for allowing ink to be fired in the form of droplets when the vibrating plate is vibrated; and a plurality of nozzles formed in the nozzle plate for firing ink to a recording device. The printer head can further comprise an auxiliary plate coupled to a lower part of the ink storing chamber to cover the ink storing chamber.

An entire structure of the printer head is changed depending upon an etching method used for etching the substrate and whether or not an auxiliary plate is used. Typical examples for several cases are illustrated in FIGS. 44 through 47.

Figure 44:
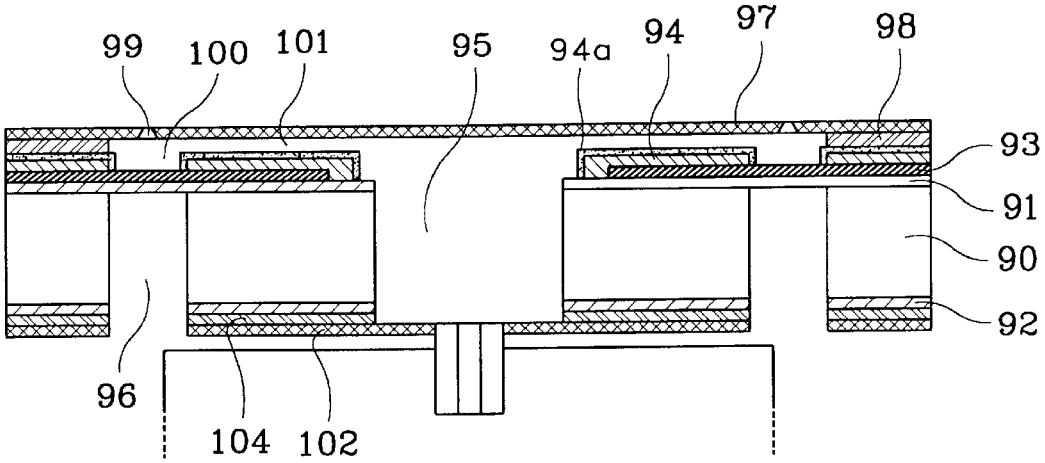
FIG. 44 is a cross-sectional view illustrating a printer head using shape memory alloy, manufactured according to the present invention.
Figure 45:
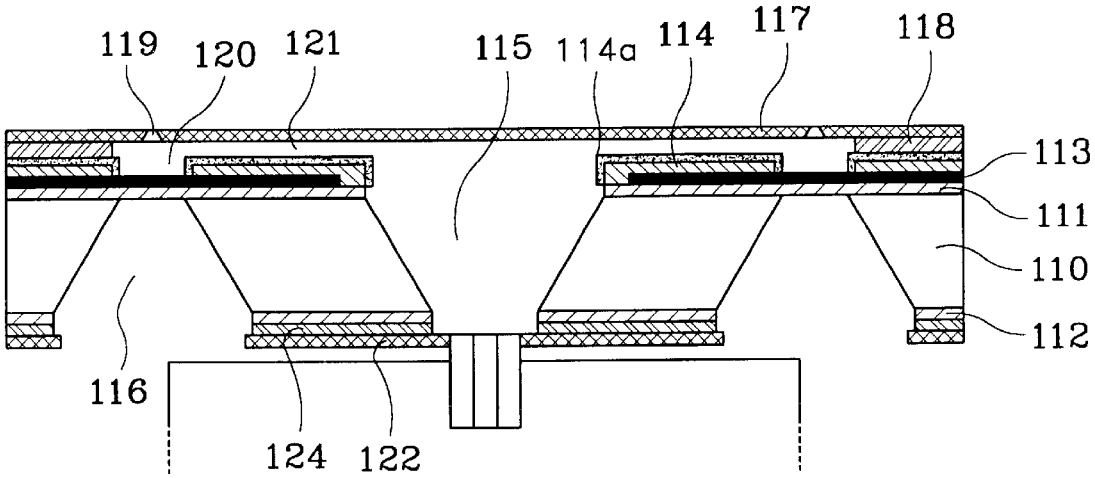
FIG. 45 is a cross-sectional view illustrating another printer head using shape memory alloy, manufactured according to the present invention.
Figure 46:
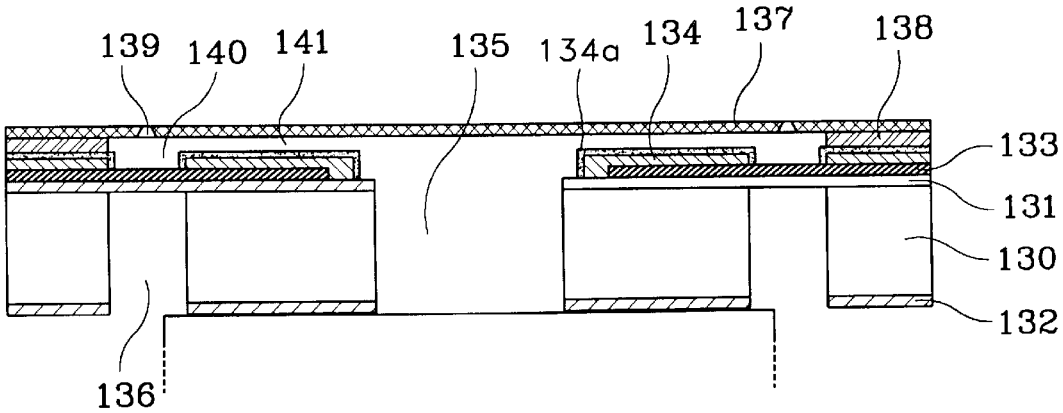
FIG. 46 is a cross-sectional view illustrating another printer head using shape memory alloy, manufactured according to the present invention.
Figure 47:
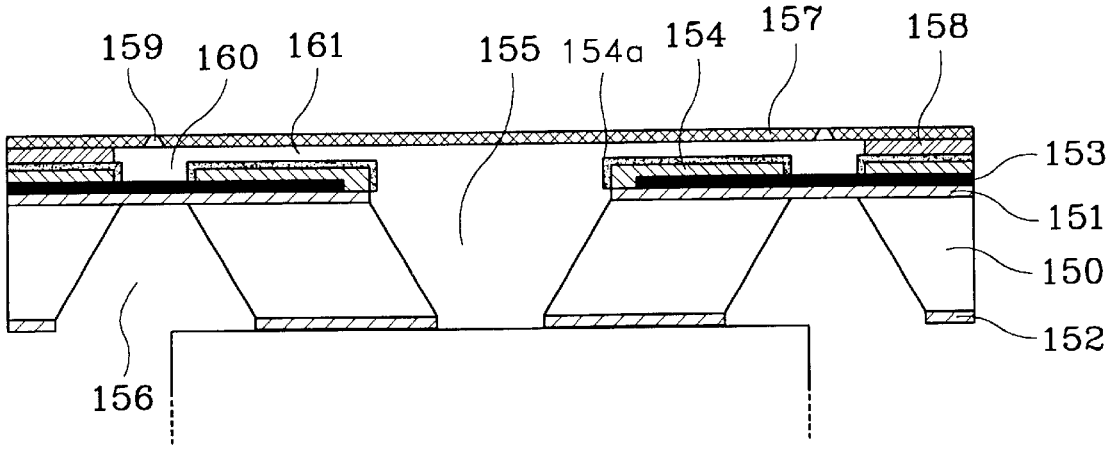
FIG. 47 is a cross-sectional view illustrating another printer head using shape memory alloy, manufactured according to the present invention.

FIG. 44 illustrates a case wherein a substrate is etched by a dry etching technique and an auxiliary plate is used, FIG. 45 illustrates a case wherein a substrate is etched by a wet etching technique and an auxiliary plate is used, FIG. 46 illustrates a case wherein a substrate is etched by a dry etching technique and an auxiliary plate is not used, and FIG. 47 illustrates a case wherein a substrate is etched by a wet etching technique and an auxiliary plate is not used.

All of these four types of printer heads can be manufactured by the methods for manufacturing a printer head using shape memory alloy, of the present invention, as aforementioned above.

However, in an etching method, when a substrate is etched by a dry etching technique rather than a wet etching technique, integration density of nozzles can be increased and an entire structure can be miniaturized. Also, when a printer head is manufactured using an auxiliary plate rather than not using an auxiliary plate, stability of the printer head can be elevated.

Figure 48:
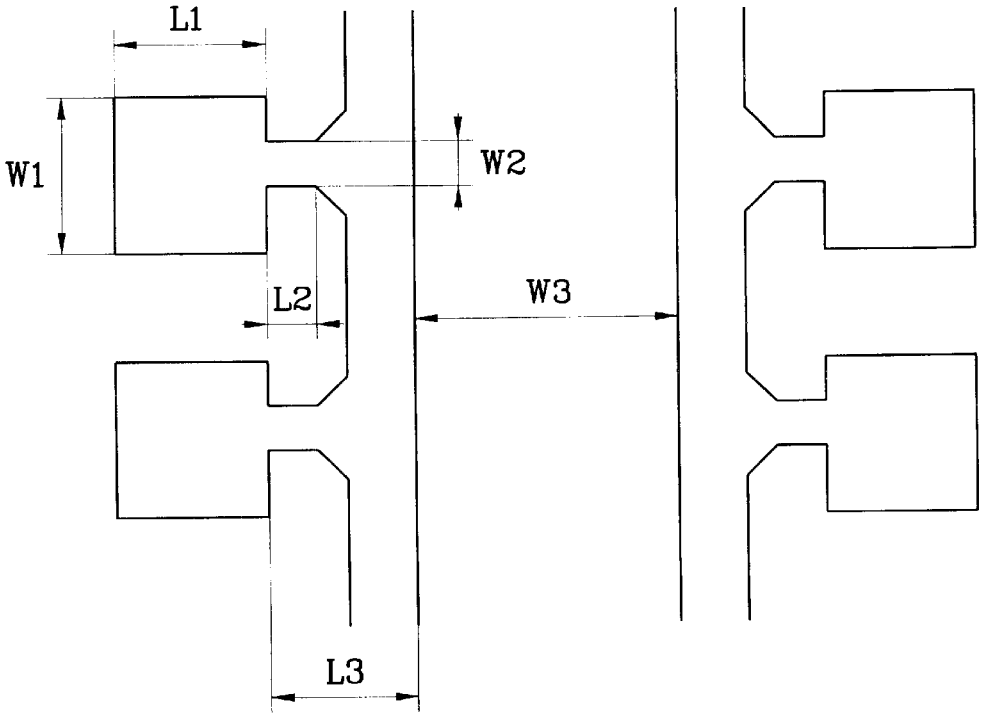
FIG. 48 is a plan view schematically illustrating the printer head according to the present invention.

FIG. 48 is a plan view schematically illustrating the printer head according to the present invention.

In the printer head of the present invention, in order to improve ink firing capability, it is preferred that sizes of main components are determined as described below.

While the size of the pressure chamber can vary depending upon a size of the vibrating plate, it is generally preferred that its width (W1) is 35–500 μm, its length (L1) is 35–500 μm and its height is 10–200 μm, and it is specifically preferred that its width (W1) is 35–210 μm, its length (L1) is 35–210 μm and its height is 10–50 μm.

It is preferred that the area of the pressure chamber is substantially the same as that of the vibrating plate to prevent pressure from being dissipated, and the height of the pressure chamber is lowered to allow shock to be easily transferred to a meniscus. Also, if the size of the pressure chamber is small, because a resonance frequency of the pressure chamber is increased, it is preferred that the size of the pressure chamber is small to increase an operation frequency.

It is preferred that the nozzle greatly influencing the formation of droplets has a diameter of 20–50 μm.

If the size of the nozzle is excessively small, firing energy may be lost in a direction toward an ink supply port due to a viscosity of ink or a crosstalk may be caused. On the contrary, if the size of the nozzle is excessively large, because pressure is lost and the meniscus deeply enters toward the pressure chamber after firing, problems are caused in that an air inflow is generated and a time for replenishing ink is lengthened.

While the size of the ink supply port can vary depending upon the size of the nozzle, when the nozzle has a diameter of 20–50 μm, it is preferred that its width (W2) is 20–200 μm, its length (L2) is 10–1,000 μm and its height is 10–200 μm, and it is specifically preferred that its width (W2) is 20–100 μm, its length (L2) is 20–200 μm and its height is 10–50 μm.

If the size of the ink supply port is excessively large, a pressure loss upon firing is increased to affect velocity and the size of droplets. Also, even after ink is fired, because intensity of inertial flow discharged from the ink supply port is fairly large, the meniscus is exposed out of a nozzle face, thereby to cause wetting. Further, since stability of the meniscus is deteriorated, firing stability is also reduced. On the contrary, if the size of the ink supply port is excessively small, ink cannot be properly supplied, decreasing operation frequency.

It is preferred that the size of the ink storing chamber is determined such that its width (W3) is 100–2,000 μm and its height is 50–700 μm, and it is specifically preferred that its width (W3) is 300–1,000 μm and its height is 100–500 μm.

If the size of the ink storing chamber is excessively small, ink cannot be properly supplied. Accordingly, an operation frequency is decreased, the size and velocity of droplets have a tendency to vary depending upon the operation frequency, pressure waves are propagated into other pressure chambers, and a crosstalk is generated. Therefore, the size of the ink storing chamber must not be excessively small but be large enough to sufficiently supply ink into the pressure chamber.

A distance between the ink storing chamber and the pressure chamber is also considered as one of important factors.

In other words, if a distance between the ink storing chamber and the pressure chamber is excessively long, incoming air bubbles are not readily discharged out of the nozzle and have a tendency to remain behind. This tendency hinders ink in flowing, thereby to affect firing. Further, because a viscosity is increased while the ink reaches the pressure chamber, to hinder ink in flowing, a printer head cannot be operated at a high frequency.

Consequently, it is preferred that the distance between the ink storing chamber and the pressure chamber is as short as possible. In this connection, it is preferred that a distance between the ink storing chamber and the pressure chamber (L3) is 10–1,000 μm, and it is specifically preferred that the distance (L3) is 20–500 μm.

Figure 50:
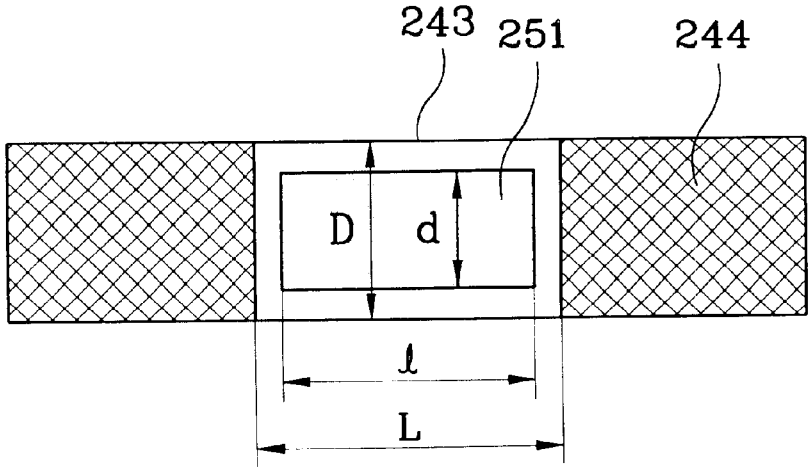
FIG. 50 is a plan view illustrating an actuator of the printer head according to the present invention.

FIG. 50 is a plan view illustrating an actuator of the printer head according to the present invention.

In an actuator of a printer head, if the size of a vibrating plate is small, since it is possible to heat the vibrating plate with only a little energy, energy consumption is decreased, heating and cooling rapidly proceed thereby to elevate reactivity, and integration density of nozzles can be raised thereby enabling an entire structure to be miniaturized.

Since various problems as described above are caused in the actuator when the size of the vibrating plate is large, it is preferred that the size of the vibrating plate is determined such that its width is 25–500 μm, its length is 25–500 μm and its thickness is 0.3–10 μm, and it is specifically preferred that its width is 25–250 μm, its length is 25–250 μm and its thickness is 0.8–7 μm.

If the shape memory alloy is thick and an area thereof is wide, since various problems as described above are caused, it is preferred that the shape memory alloy has a thickness of 0.3–5 μm. Also, it is preferred that the size of a portion of the shape memory alloy, which is exposed, is determined such that its width is 35–500 μm and its length is 35–500 μm, and it is specifically preferred that its width is 35–210 μm and its length is 35–210 μm.

Moreover, if the silicon dioxide layer serving as the second thin film is thick, energy consumption is increased when the shape memory alloy is flattened by heating, and if the silicon dioxide layer is thin, restoring force for restoring the shape memory alloy to its flexed state upon cooling is reduced. Accordingly, it is preferred that the silicon dioxide layer has a thickness of 0.3–2.0 μm.

As described above, if the shape memory alloy used as the vibrating plate is thin in its thickness and narrow in its area, since heating proceeds rapidly, heating time and cooling time are shortened whereby an operation frequency can be increased. Further, due to the fact that the shape memory alloy is heated with only a little energy, energy consumption is reduced, and heat loss is lowered whereby energy consumed upon firing ink can be lessened.

In addition, since an interval between two adjoining nozzles can be shortened, integration density of nozzles can be elevated, and since residual vibration due to pressure waves after firing is reduced, stable firing can be accomplished.

FIG. 50 is a plan view illustrating an actuator of the printer head according to the present invention.

In order to shorten a heating time by reducing energy consumption upon heating while securing a volumetric displacement of the pressure chamber, which is sufficient for firing ink, it is preferred that the width (d) of the vibrating plate is decreased and the length (l) of the vibrating plate is lengthened.

While it is preferred that a ratio between the width (d) and the length (l) of the vibrating plate is generally 1:1–1:2, the ratio can be varied depending upon a printer head used.

Figure 49:
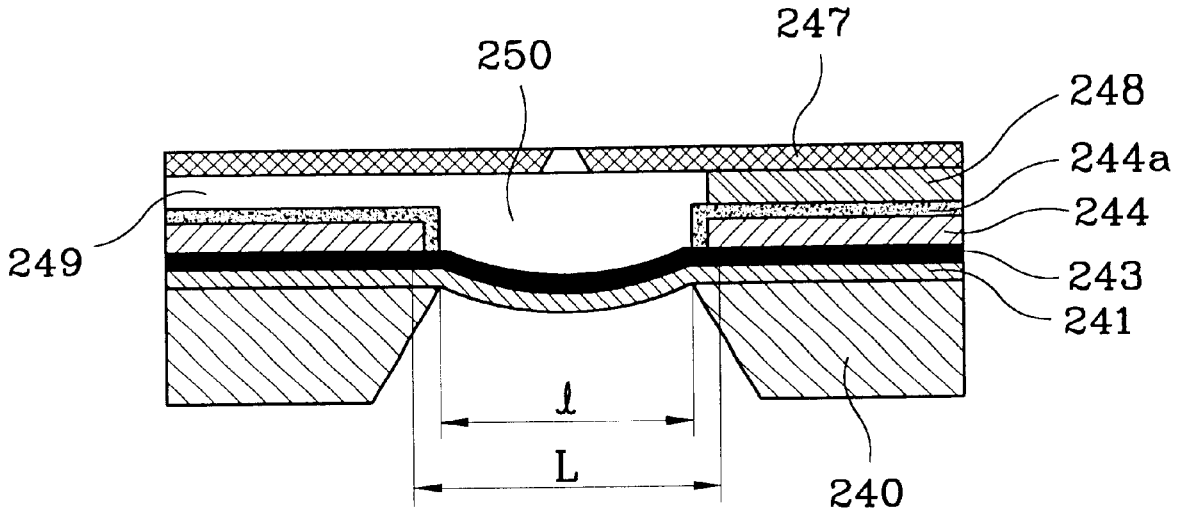
FIG. 49 is a cross-sectional view schematically illustrating a firing device of the printer head according to the present invention.

FIG. 49 is a cross-sectional view schematically illustrating a firing device of the printer head according to the present invention. In the printer head using shape memory alloy of the present invention, ink supplied from the ink cartridge which is connected to the ink storing chamber through the ink storing chamber and the fluid passage to the pressure chamber, is fired onto a recording medium while passing through paths described below.

While the shape memory alloy layer 243 of the vibrating plate section has a flattened configuration in its original configuration, it has a residual compression stress in the course of forming it as a film onto a substrate by deposition, etc. Accordingly, it is possible to change a magnitude of the residual compression stress which remains in the shape memory alloy, depending upon deposition conditions, a thermal treating temperature, a time, etc. when performing deposition on the substrate.

If space parts are formed in lower parts of the substrate by etching portions of the substrate, the shape memory alloy is flexurally deformed due to a buckling phenomenon by the compression stress which remains in the silicon dioxide layer. The shape memory alloy is maintained as it is flexurally deformed.

If electric power is applied to the printer head, electric power is supplied to the electrode 244 and heat is generated in the electrode 244. By the heat generated in the electrode 244, the shape memory alloy 243 which is in a flexurally deformed state, is heated. When heated, the shape memory alloy 243 is flattened to be returned to its original configuration, and in this manner, volume of the pressure chamber 250 is reduced and ink is fired through the plurality of nozzles.

On the contrary, if the shape memory alloy 243 is cooled, since the flexural deformation is generated by the residual compression stress of the silicon dioxide, volume of the pressure chamber 250 is increased again, and ink is replenished by an amount of increased volume.

At this time, because the silicon dioxide layers 241 which are formed on the surfaces of the substrate have elasticity by which they are flexed by themselves, the silicon dioxide layers 241 provide restoring force for enabling the shape memory alloy 243 which is flattened by being heated, to be flexurally deformed while being cooled.

In the printer head using shape memory alloy, these processes are repeated to continuously fire ink, thereby to perform a printing operation.

As described above, in the present invention, by using shape memory alloy of the form of a thin film-shaped configuration manufactured by a semiconductor thin film manufacturing process and by manufacturing the printer head by forming a lower structure using an etching technique, reliability for the printer head structure and productivity of the printer head are improved.

Further, the present invention provides an entire structure of a printer head using shape memory alloy, which is not described in the conventional art. In addition, due to the fact that sizes of the components constituting the printer head using shape memory alloy are decreased, integration density of nozzles is elevated, thereby improving printing resolution.

Reference will now be made in greater detail to a preferred embodiment of the invention, an example of which is illustrated in the accompanying drawings. Wherever possible, the same reference numerals will be used throughout the drawings and the description to refer to the same or like parts.

FIGS. 4 through 12 are cross-sectional views for explaining a method for manufacturing a printer head using shape memory alloy, which does not use an auxiliary plate, in accordance with an embodiment of the present invention.

By thermally oxidizing both surfaces of a silicon substrate 40, a pair of silicon dioxide layers 41 and 42 are formed on both surfaces of the silicon substrate 40, respectively. A shape memory alloy 43 is deposited by sputtering onto the silicon dioxide layer 41 which is formed on the surface of the substrate 40 by thermal oxidation, and then, is thermally treated, that is, baked.

The shape memory alloy 43 which is deposited and thermally treated, is patterned by photolithography, and the silicon dioxide layers 41 and 42 which are formed on both surfaces of the substrate 40, respectively, are also patterned by photolithography.

An electrode 44 is formed such that it covers the patterned shape memory alloy 43 and the silicon dioxide layer 41 and it does not cover vibrating plate sections.

After the electrode 44 is formed, an insulating layer 44*a* is deposited onto the electrode 44. After the insulating layer 44*a* is deposited, the substrate 40 is wholly etched by a wet etching technique to define an ink storing chamber 45 and space parts 46 which are arranged below the vibrating plate sections, thereby to complete a body of a printer head.

A nozzle plate 47 in which a plurality of nozzles 49 are defined is separately formed. A photosensitive dry film is applied onto the nozzle plate 47 which is formed. Thereafter, by patterning the photosensitive dry film using photolithography, a fluid passage plate 48 is prepared.

The nozzle plate 47 and the fluid passage plate 48 are coupled to the body of the printer head, to complete the printer head.

FIGS. 13 through 22 are cross-sectional views for explaining a method for manufacturing a printer head using shape memory alloy, which does not use an auxiliary plate, in accordance with another embodiment of the present invention.

By thermally oxidizing both surfaces of a silicon substrate 50, a pair of silicon dioxide layers 51 and 52 are formed on both surfaces of the silicon substrate 50, respectively. A shape memory alloy 53 is deposited by sputtering onto the silicon dioxide layer 51 which is formed on the surface of the substrate 50 by thermal oxidation, and then, is thermally treated, that is, baked.

The shape memory alloy 53 which is deposited and thermally treated, is patterned by photolithography, and the silicon dioxide layers 51 and 52 which are formed on both surfaces of the substrate 50, respectively, are also patterned by photolithography.

An electrode 54 is formed such that it covers the patterned shape memory alloy 53 and the silicon dioxide layer 51 and it does not cover vibrating plate sections.

After the electrode 54 is formed, an insulating layer 54*a* is deposited onto the electrode 54. After the insulating layer 54*a* is deposited, the substrate 50 is wholly etched by a dry etching technique to define an ink storing chamber 55 and space parts 56 which are arranged below the vibrating plate sections.

A photosensitive dry film is applied onto the electrode 54. Then, the photosensitive dry film is patterned by photolithography to prepare a fluid passage plate 58, thereby to complete a body of a printer head.

A nozzle plate 57 in which a plurality of nozzles 59 are defined, is separately formed. The nozzle plate 57 is coupled onto the fluid passage plate 58 to complete the printer head.

FIGS. 23 through 32 are cross-sectional views for explaining a method for manufacturing a printer head using shape memory alloy, which does not use an auxiliary plate, in accordance with another embodiment of the present invention.

By thermally oxidizing both surfaces of a silicon substrate 60, a pair of silicon dioxide layers 61 and 62 are formed on both surfaces of the silicon substrate 60, respectively. A shape memory alloy 63 is deposited by sputtering onto the silicon dioxide layer 61 which is formed on the surface of the substrate 60 by thermal oxidation, and then, is thermally treated, that is, baked.

The shape memory alloy 63 which is deposited and thermally treated, is patterned by photolithography, and the silicon dioxide layers 61 and 62 which are formed on both surfaces of the substrate 60, respectively, are also patterned by photolithography.

An electrode 64 is formed such that it covers the patterned shape memory alloy 63 and the silicon dioxide layer 61 and it does not cover a vibrating plate sections.

After the electrode 64 is formed, an insulating layer 64*a* is deposited onto the electrode 64. A photosensitive dry film is applied onto the insulating layer 64*a* which is formed. Then, the photosensitive dry film is patterned by photolithography to prepare a fluid passage plate 68.

A nozzle plate 67 in which a plurality of nozzles 69 are defined, is separately formed. The nozzle plate 67 is coupled onto the fluid passage plate 68.

After the nozzle plate 67 is coupled onto the fluid passage plate 68, the substrate 60 is wholly etched by a dry etching technique to define an ink storing chamber 65 and space parts 66 which are arranged below the vibrating plate sections, thereby to complete a printer head.

FIGS. 33 through 43 are cross-sectional views for explaining a method for manufacturing a printer head using shape memory alloy, which uses an auxiliary plate, in accordance with another embodiment of the present invention.

In the present embodiment, processes for manufacturing a printer head (see FIGS. 33 through 40) are the same as those employed in the embodiment shown in FIGS. 4 through 12, and steps for manufacturing and attaching a separate auxiliary plate are added.

An auxiliary plate 82 is patterned to a pattern which is suitable for being adapted to a printer head manufactured by the above embodiments. A photosensitive dry film 84 is applied onto the auxiliary plate 82 which is patterned. The photosensitive dry film 84 is patterned depending upon a lower structure of a printer head to be bonded.

The patterned auxiliary plate 82 and the nozzle plate 77 are simultaneously attached to a body of a printer head.

FIG. 44 is a cross-sectional view illustrating a printer head using shape memory alloy, manufactured according to the present invention, wherein a substrate is etched by a dry etching technique and an auxiliary plate is used.

A printer head of this embodiment has an ink storing chamber 95 which is formed in a center portion of a substrate 90 by a dry etching technique, and space parts 96 which are formed on the left and right of the substrate 90, respectively. A vibrating plate which comprises a silicon dioxide layer 91 and a shape memory alloy layer 93 is disposed above the space parts 96, and an electrode 94 is formed on the vibrating plate.

An insulating layer 94*a* is formed on the electrode 94, and a fluid passage plate 98 is formed on a side of the insulating layer 94*a*. A nozzle plate 97 in which a plurality of nozzles 99 are formed, is formed on the fluid passage plate 98. A fluid passage 101 is defined by the fluid passage plate 98, and a pressure chamber 100 is defined between the fluid passage 101 and the fluid passage plate 98.

An auxiliary plate 102 which is formed with a photosensitive dry film 104, is coupled to a lower part of the substrate 90 to close the ink storing chamber 95.

FIG. 45 is a cross-sectional view illustrating another printer head using shape memory alloy, manufactured according to the present invention, wherein a substrate is etched by a wet etching technique and an auxiliary plate is used.

A printer head of this embodiment has an ink storing chamber 115 which is formed in a center portion of a substrate 110 by a wet etching technique, and space parts 116 which are formed on the left and right of the substrate 110, respectively. A vibrating plate which comprises a silicon dioxide layer 111 and a shape memory alloy layer 113 is disposed above the space parts 116, and an electrode 114 is formed on the vibrating plate.

An insulating layer 114*a* is formed on the electrode 114, and a fluid passage plate 118 is formed on a side of the insulating layer 114*a*. A nozzle plate 117 in which a plurality of nozzles 119 are formed, is formed on the fluid passage plate 118. A fluid passage 121 is defined by the fluid passage plate 118, and a pressure chamber 120 is defined between the fluid passage 121 and the fluid passage plate 118.

An auxiliary plate 122 which is formed with a photosensitive dry film 124, is coupled to a lower part of the substrate 110 to close the ink storing chamber 115.

FIG. 46 is a cross-sectional view illustrating another printer head using shape memory alloy, manufactured according to the present invention, wherein a substrate is etched by a dry etching technique and an auxiliary plate is not used.

A printer head of this embodiment has an ink storing chamber 135 which is formed in a center portion of a substrate 130 by a dry etching technique, and space parts 136 which are formed on the left and right of the substrate 130, respectively. A vibrating plate which comprises a silicon dioxide layer 131 and a shape memory alloy layer 133 is disposed above the space parts 136, and an electrode 134 is formed on the vibrating plate.

An insulating layer 134*a* is formed on the electrode 134, and a fluid passage plate 138 is formed on a side of the insulating layer 134*a*. A nozzle plate 137 in which a plurality of nozzles 139 are formed, is formed on the fluid passage plate 138. A fluid passage 141 is defined by the fluid passage plate 138, and a pressure chamber 140 is defined between the fluid passage 141 and the fluid passage plate 138.

FIG. 47 is a cross-sectional view illustrating another printer head using shape memory alloy, manufactured according to the present invention, wherein a substrate is etched by a wet etching technique and an auxiliary plate is not used.

A printer head of this embodiment has an ink storing chamber 155 which is formed in a center portion of a substrate 150 by a wet etching technique, and space parts 156 which are formed on the left and right of the substrate 150, respectively. A vibrating plate which comprises a silicon dioxide layer 151 and a shape memory alloy layer 153 is disposed above the space parts 156, and an electrode 154 is formed on the vibrating plate.

An insulating layer 154*a* is formed on the electrode 154, and a fluid passage plate 158 is formed on a side of the insulating layer 154*a*. A nozzle plate 157 in which a plurality of nozzles 159 are formed, is formed on the fluid passage plate 158. A fluid passage 161 is defined by the fluid passage plate 158, and a pressure chamber 160 is defined between the fluid passage 161 and the fluid passage plate 158.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A method for manufacturing a printer head using shape memory alloy, comprising the steps of:

preparing a silicon substrate having a flat configuration;

thermally oxidizing the silicon substrate to form a pair of silicon dioxide layers on both surfaces of the silicon substrate, respectively;

forming a shape memory alloy layer on one of the pair of silicon dioxide layers by a semiconductor thin film forming process;

thermally treating the formed shape memory alloy layer;

patterning the shape memory alloy layer;

patterning the silicon dioxide layers formed on both surfaces of the silicon substrate, respectively;

forming an electrode on the shape memory alloy layer to have a desired pattern;

forming an insulating layer for protecting the electrode;

forming a body of the printer head by etching the silicon substrate on which the electrode and insulating layer are formed;

separately forming a nozzle plate into which a plurality of nozzles are formed;

forming a fluid passage plate by bonding a photosensitive dry film onto the nozzle plate and patterning the photosensitive dry film; and bonding the nozzle plate and the fluid passage plate onto the body of the printer head.

2. A method as claimed in claim 1, wherein the electrode is made of material selected from a group consisting of aluminum (Al), gold (Au), platinum (Pt) and silver (Ag).

3. A method as claimed in claim 1, further comprising the steps of:

forming an auxiliary plate;

applying a photosensitive dry film on the auxiliary plate and patterning the photosensitive dry film; and bonding the auxiliary plate on which the photosensitive dry film is patterned, onto the other of the pair of silicon dioxide layers.

4. A method as claimed in claim 3, wherein the auxiliary plate is made of stainless steel (SUS) or nickel (Ni).

5. A method as claimed in claim 3, wherein the auxiliary plate is bonded onto the other of the pair of silicon dioxide layers at the same time when the nozzle plate and the fluid passage plate are bonded onto the body of the printer head.

6. A method as claimed in claim 1, wherein the silicon dioxide layer has a thickness of 0.3–2 $\mu$m.

7. A method as claimed in claim 1, wherein the shape memory alloy has a thickness of 0.3–5 $\mu$m.

8. A method as claimed in claim 1, wherein the silicon substrate is etched by a dry etching technique.

9. A method for manufacturing a printer head using shape memory alloy, comprising the steps of:

preparing a silicon substrate having a flat configuration;

thermally oxidizing the silicon substrate to form a pair of silicon dioxide layers on both surfaces of the silicon substrate, respectively;

forming a shape memory alloy layer on one of the pair of silicon dioxide layers by a semiconductor thin film forming process;

thermally treating the formed shape memory alloy layer;

patterning the shape memory alloy layer;

patterning the silicon dioxide layers formed on both surfaces of the silicon substrate, respectively;

forming an electrode on the shape memory alloy layer to have a desired pattern;

forming an insulating layer for protecting the electrode;

applying a photosensitive dry film onto the insulating layer and patterning the photosensitive film;

forming a body of the printer head by dry etching the formed silicon substrate;

separately forming a nozzle plate into which a plurality of nozzles are formed; and bonding the nozzle plate onto the body of the printer head.

10. A method as claimed in claim 9, wherein the electrode is made of material selected from a group consisting of aluminum (Al), gold (Au), platinum (Pt) and silver (Ag).

11. A method as claimed in claim 9, further comprising the steps of:

forming an auxiliary plate;

applying a photosensitive dry film on the auxiliary plate and patterning the photosensitive dry film; and bonding the auxiliary plate on which the photosensitive dry film is patterned, onto the other of the pair of silicon dioxide layers.

12. A method as claimed in claim 11, wherein the auxiliary plate is made of stainless steel (SUS) or nickel (Ni).

13. A method as claimed in claim 11, wherein the auxiliary plate is bonded onto the other of the pair of silicon dioxide layers at the same time when the nozzle plate and the fluid passage plate are bonded onto the body of the printer head.

14. A method as claimed in claim 9, wherein the silicon dioxide layer has a thickness of 0.3–2 $\mu$m.

15. A method as claimed in claim 9, wherein the shape memory alloy has a thickness of 0.3–5 $\mu$m.

16. A method for manufacturing a printer head using shape memory alloy, comprising the steps of:

preparing a silicon substrate having a flat configuration;

thermally oxidizing the silicon substrate to form a pair of silicon dioxide layers on both surfaces of the silicon substrate, respectively;

forming a shape memory alloy layer on one of the pair of silicon dioxide layers by a semiconductor thin film forming process;

thermally treating the formed shape memory alloy layer;

patterning the shape memory alloy layer;

patterning the silicon dioxide layers formed on both surfaces of the silicon substrate, respectively;

forming an electrode on the shape memory alloy layer to have a desired pattern;

forming an insulating layer for protecting the electrode;

applying a photosensitive dry film onto the insulating layer and patterning the photosensitive film to define a body of the printer head;

separately forming a nozzle plate into which a plurality of nozzles are formed;

bonding the nozzle plate onto the body of the printer head; and dry etching the silicon substrate.

17. A method as claimed in claim 16, wherein the electrode is made of material selected from a group consisting of aluminum (Al), gold (Au), platinum (Pt) and silver (Ag).

18. A method as claimed in claim 16, further comprising the steps of:

forming an auxiliary plate;

applying a photosensitive dry film on the auxiliary plate and patterning the photosensitive dry film; and bonding the auxiliary plate on which the photosensitive dry film is patterned, onto the other of the pair of silicon dioxide layers.

19. A method as claimed in claim 18, wherein the auxiliary plate is made of stainless steel (SUS) or nickel (Ni).

20. A method as claimed in claim 18, wherein the auxiliary plate is bonded onto the other of the pair of silicon dioxide layers at the same time when the nozzle plate and the fluid passage plate are bonded onto the body of the printer head.

21. A method as claimed in claim 16, wherein the silicon dioxide layer has a thickness of 0.3–2 $\mu$m.

22. A method as claimed in claim 16, wherein the shape memory alloy has a thickness of 0.3–5 $\mu$m.

23. A printer head using shape memory alloy comprising:

a substrate;

space parts defined at both sides of the substrate;

a vibrating plate formed on the substrate such that it covers the space parts, to be vibrated while being changed in its contour depending upon temperature variation, the vibrating plate including a shape memory alloy layer and a silicon dioxide layer;

an electrode formed on the vibrating plate to have a desired pattern;

an insulating layer formed to protect the electrode;

an ink storing chamber formed between the space parts of the substrate for storing ink;

a pressure chamber defined on the vibrating plate for containing ink, the pressure chamber discharging ink by vibration of the vibrating plate;

a fluid passage plate formed at a side of the pressure chamber;

a fluid passage formed by the fluid passage plate for allowing the ink stored in the ink storing chamber to flow into the pressure chamber;

a nozzle plate attached onto the fluid passage plate for allowing ink to be fired in the form of droplets when the vibrating plate is vibrated; and a plurality of nozzles formed in the nozzle plate for firing ink to a recording device.

24. A printer head using shape memory alloy as claimed in claim 23, further comprising:

an auxiliary plate coupled to a lower part of the ink storing chamber to cover the ink storing chamber.

25. A printer head using shape memory alloy as claimed in claim 24, wherein the auxiliary plate is made of stainless steel (SUS) or nickel (Ni).

26. A printer head using shape memory alloy as claimed in claim 23, wherein the pressure chamber has a width of 35–500 $\mu$m, a length of 35–500 $\mu$m and a height of 10–200 $\mu$m.

27. A printer head using shape memory alloy as claimed in claim 23, wherein the nozzle has a diameter of 20–50 $\mu$m.

28. A printer head using shape memory alloy as claimed in claim 23, wherein the fluid passage has a width of 20–200 $\mu$m, a length of 10–1,000 $\mu$m and a height of 10–200 $\mu$m.

29. A printer head using shape memory alloy as claimed in claim 23, wherein the ink storing chamber has a width of 100–2,000 $\mu$m and a height of 50–700 $\mu$m.

30. A printer head using shape memory alloy as claimed in claim 23, wherein a distance between the ink storing chamber and the pressure chamber is 10–1,000 $\mu$m.

31. A printer head using shape memory alloy as claimed in claim 23, wherein an exposed portion of the shape memory alloy layer has a transverse of 35–500 $\mu$m and a longitude of 35–500 $\mu$m.

32. A printer head using shape memory alloy as claimed in claim 23, wherein the vibrating plate has a transverse of 25–500 $\mu$m, a longitude of 25–500 $\mu$m and a thickness of 0.3–10 $\mu$m.

33. A printer head using shape memory alloy as claimed in claim 32, wherein a thickness of the shape memory alloy layer is 0.3–5 $\mu$m.

34. A printer head using shape memory alloy as claimed in claim 32, wherein a thickness of the silicon dioxide layer as being a second thin film is 0.3–2.0 $\mu$m.

35. A printer head using shape memory alloy as claimed in claim 23, wherein a thickness of the shape memory alloy layer is 0.3–5 $\mu$m.

36. A printer head using shape memory alloy as claimed in claim 23, wherein a thickness of the silicon dioxide layer as being a second thin film is 0.3–2.0 $\mu$m.

37. A printer head using shape memory alloy as claimed in claim 23, wherein the electrode is made of material selected from a group consisting of aluminum (Al), gold (Au), platinum (Pt) and silver (Ag).

* * * * *